US010194739B2

(12) United States Patent
Jungnickel

(10) Patent No.: US 10,194,739 B2
(45) Date of Patent: Feb. 5, 2019

(54) HEAD FOR AN ORAL CARE IMPLEMENT

(71) Applicant: The Procter & Gamble Company, Cincinnati, OH (US)

(72) Inventor: Uwe Jungnickel, Koenigstein (DE)

(73) Assignee: THE PROCTER & GAMBLE COMPANY, Cincinnati, OH (US)

( * ) Notice: Subject to any disclaimer, the term of this patent is extended or adjusted under 35 U.S.C. 154(b) by 0 days.

(21) Appl. No.: 14/795,457

(22) Filed: Jul. 9, 2015

(65) Prior Publication Data

US 2016/0007727 A1 Jan. 14, 2016

(30) Foreign Application Priority Data

Jul. 11, 2014 (EP) ..... 14176721

(51) Int. Cl.

| | |
|---|---|
| ***A46B 9/04*** | (2006.01) |
| ***A46B 9/00*** | (2006.01) |
| ***A46B 3/06*** | (2006.01) |
| ***A46B 9/02*** | (2006.01) |
| *A46B 9/06* | (2006.01) |

(52) U.S. Cl.

CPC ..... *A46B 9/04* (2013.01); *A46B 3/06* (2013.01); *A46B 9/026* (2013.01); *A46B 9/06* (2013.01); *A46B 2200/1066* (2013.01)

(58) Field of Classification Search

CPC .... A46B 9/00; A46B 9/02; A46B 9/04; A46B 9/026; A46B 3/06

USPC ..... 15/110, 167.1

See application file for complete search history.

(56) References Cited

U.S. PATENT DOCUMENTS

| | | | | |
|---|---|---|---|---|
| 6,276,021 | B1 * | 8/2001 | Hohlbein | A46B 9/04 15/167.1 |
| 7,322,066 | B2 * | 1/2008 | Ping | A61C 17/349 15/22.1 |
| D675,024 | S * | 1/2013 | Blanchard | D4/104 |
| 8,595,886 | B2 * | 12/2013 | Edelstein | A46B 5/026 15/167.1 |
| 8,863,345 | B2 * | 10/2014 | Jimenez | A46B 9/04 15/167.1 |
| D753,922 | S * | 4/2016 | Jimenez | D4/104 |
| 9,364,303 | B2 * | 6/2016 | Driesen | A61C 17/3436 |
| 2003/0229959 | A1 * | 12/2003 | Gavney, Jr. | A46B 9/005 15/117 |

(Continued)

FOREIGN PATENT DOCUMENTS

| | | |
|---|---|---|
| DE | 202010015056 | 2/2011 |
| JP | H1-71580 | 1/1991 |

(Continued)

*Primary Examiner* — Michael Jennings

(74) *Attorney, Agent, or Firm* — Vladimir Vitenberg

(57) ABSTRACT

A head for an oral care implement comprises a mounting surface having a maximum longitudinal extension and a longitudinal axis extending along the maximum longitudinal extension. At least one tuft extends from the mounting surface. The tuft has a longitudinal axis and a cross-sectional area extending in a plane perpendicular to the longitudinal axis. The cross-sectional area has a shape substantially of a parallelogram with two pairs of substantially parallel sides forming four angles and a diagonal joining two non-consecutive angles of the parallelogram. The sides of the parallelogram have a length of at least 3.5 mm. The at least one tuft extends from the mounting surface so that the diagonal of the parallelogram is substantially parallel to the longitudinal axis of the mounting surface.

18 Claims, 3 Drawing Sheets

(56) References Cited

U.S. PATENT DOCUMENTS

| | | | | |
|---|---|---|---|---|
| 2004/0177462 | A1* | 9/2004 | Brown, Jr. | A46B 3/16 15/167.1 |
| 2004/0200016 | A1* | 10/2004 | Chan | A46B 9/04 15/22.1 |
| 2006/0026784 | A1* | 2/2006 | Moskovich | A46B 5/0062 15/110 |
| 2007/0056128 | A1* | 3/2007 | Hohlbein | A46B 9/028 15/110 |
| 2010/0050356 | A1* | 3/2010 | Baertschi | A46B 9/005 15/167.1 |
| 2011/0138560 | A1 | 6/2011 | Vitt et al. | |
| 2011/0219558 | A1* | 9/2011 | Vitt | A46B 3/22 15/167.1 |
| 2011/0289708 | A1* | 12/2011 | Jimenez | A46B 9/04 15/106 |
| 2011/0304194 | A1 | 12/2011 | Uchida et al. | |
| 2011/0308029 | A1* | 12/2011 | Edelstein | A46B 5/026 15/167.1 |
| 2012/0073070 | A1* | 3/2012 | Nirwing | A46B 9/08 15/167.1 |
| 2013/0318732 | A1* | 12/2013 | Mintel | A46D 1/0276 15/167.1 |

FOREIGN PATENT DOCUMENTS

| | | |
|---|---|---|
| JP | 2007143908 | 6/2007 |
| JP | 2013154096 | 8/2013 |
| WO | WO2011028607 | 3/2011 |
| WO | WO2011070549 | 6/2011 |
| WO | WO2012096701 | 7/2012 |

* cited by examiner

HEAD FOR AN ORAL CARE IMPLEMENT

FIELD OF THE INVENTION

The present disclosure is concerned with a head for an oral care implement and in particular with such a head comprising at least one tuft having a cross-sectional area with a shape substantially of a parallelogram.

BACKGROUND OF THE INVENTION

Tufts composed of a plurality of filaments for oral care implements, like manual and powered toothbrushes are well known in the art. Generally, the tufts are attached to a mounting surface of a head intended for insertion into a user's oral cavity. A grip handle is usually attached to the head, which handle is held by the user during brushing. The head is either permanently connected or repeatedly attachable to and detachable from the handle.

It is known that tufts often have a substantially circular cross-sectional shape with a diameter of about 1.5 mm to about 2.5 mm. While toothbrushes comprising this type of tufts clean the outer buccal face of teeth adequately, they are not as well suited to provide intensive surface cleaning and polishing effects of the outer surfaces of the teeth.

Brush heads comprising so called block tufts are also known in the art. Some block tufts known in the art have a cross-sectional area in a shape of a square. Typically, two opposite sides of the square extend along the length extension of the head and two opposite sides extend substantially perpendicular thereto. However, the block tufts known in the art do not provide gentle and pleasant in-mouth perception during a brushing action, but a rather bulky sensation.

It is an object of the present disclosure to provide a head for an oral care implement which provides improved cleaning properties, in particular with respect to intensive surface cleaning and polishing effects of the outer surfaces of the teeth thereby providing a comfortable, pleasant and gentle in-mouth perception during a brushing action. It is also an object of the present disclosure to provide an oral care implement comprising such head.

SUMMARY OF THE INVENTION

In accordance with one aspect, a head for an oral care implement is provided that comprises:

- a mounting surface having a maximum longitudinal extension and a longitudinal axis extending along the maximum longitudinal extension,
- the head further comprises at least one tuft extending from the mounting surface,
- the tuft having a longitudinal axis and a cross-sectional area extending in a plane perpendicular to the longitudinal axis and the cross-sectional area having a shape substantially of a parallelogram with two pairs of substantially parallel sides forming four angles, and a diagonal joining two non-consecutive angles of the parallelogram, the sides of the parallelogram having a length of at least 3.5 mm, wherein
- the at least one tuft extends from the mounting surface in a manner that the diagonal of the parallelogram is substantially parallel to the longitudinal axis of the mounting surface.

In accordance with one aspect, an oral care implement is provided that comprises such head.

BRIEF DESCRIPTION OF THE DRAWINGS

The invention is described in more detail below with reference to various embodiments and figures, wherein.

DETAILED DESCRIPTION OF THE INVENTION

Figure 1:
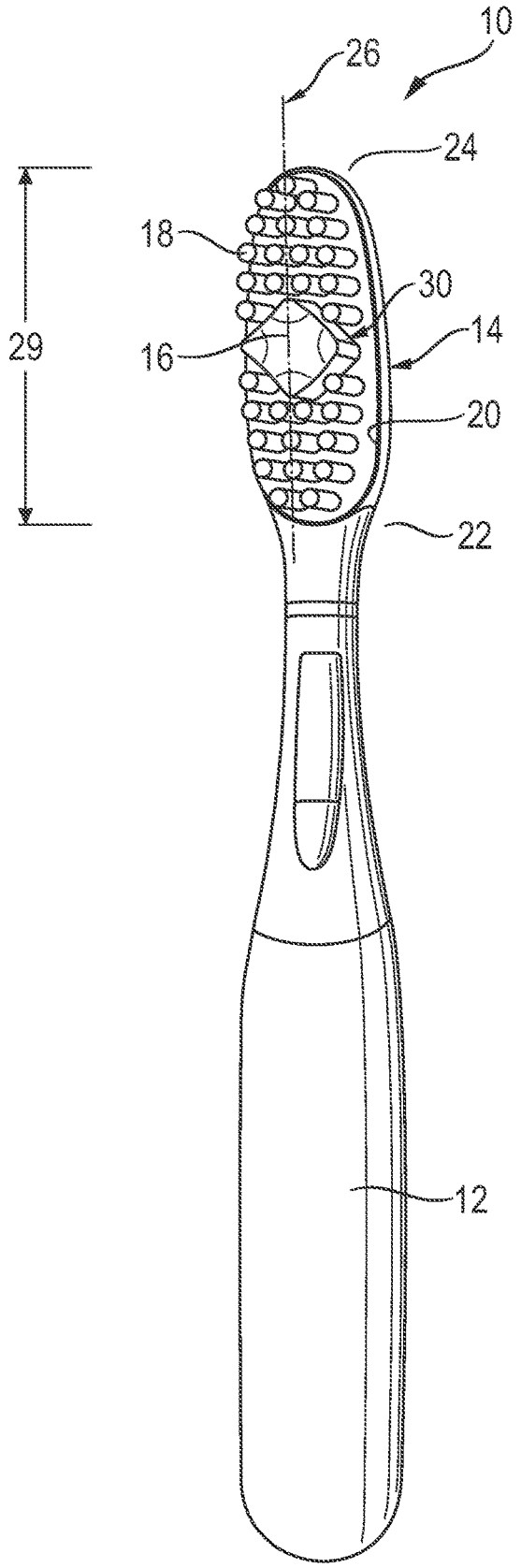
FIG. 1 shows a perspective view of an example embodiment of an oral care implement.

A head for an oral care implement in accordance with the present disclosure comprises at least one tuft of filaments which extends from a mounting surface of the head. The mounting surface has a maximum longitudinal extension along which a longitudinal axis of the mounting surface is defined.

The at least one tuft has a longitudinal axis extending along its filament extension and a cross-sectional area perpendicular to the longitudinal axis. The cross-sectional area has the shape substantially of a parallelogram. In the context of the present disclosure a "parallelogram" is defined as a quadrilateral with two pairs of parallel sides. The opposite or facing sides are of equal length and opposite angles are of equal measure. The parallelogram comprises two diagonals joining/connecting two non-consecutive angles of the parallelogram.

The at least one tuft is arranged on the mounting surface of the head in a manner that one of the diagonals of the parallelogram is substantially parallel to the longitudinal axis of the mounting surface. In other words, one of the two diagonals is aligned with the maximum longitudinal extension of the mounting surface. In some embodiments, in case the diagonals are of different lengths, the diagonal with the larger length may be substantially parallel to the longitudinal axis of the mounting surface. In some embodiments, the head may have an axis of symmetry and the longitudinal axis lies in said axis of symmetry.

All sides of the parallelogram have a length of at least 3.5 mm. Since such tuft has a relatively large cross-sectional area comprising a higher amount of filaments compared to conventional tufts, this type of tuft is also referred to as "block tuft". Due to the relatively high amount of filaments, the "block tuft" in accordance with the present disclosure may provide improved cleaning performance, like effective stain removal, intensive surface cleaning and polishing effects. The filaments may provide each other with a counterforce during a brushing action and, thus, with increased stability/bending stiffness which may result in increased contact pressure when the filaments come into contact with the teeth surfaces. The increased stability/bending stiffness may also allow relatively soft filaments to transmit sufficient contact pressure to clean the teeth effectively.

The head comprising a "block tuft" in accordance with the present disclosure may provide a smooth transition between the at least one "block tuft" and the teeth during a brushing action, since no sides of the parallelogram are orthogonal with respect to a longitudinal or vertical brushing direction of the head, i.e. during scrubbing motions (along the rows of teeth) as well as during up and down brushing (from the teeth to the gums and vice versa). In the direction of movement, one of the four edges/angles of the "block tuft" comes first into contact with the teeth. At that point of contact the "block tuft" has a bending stiffness similar to a conventional tuft. With further movement, the width of the "block tuft" increases continuously and therewith the stiffness of the tuft. This leads to a homogeneous transition from a "conventional tuft" in-mouth perception to a "block tuft" perception. Thus, an improved in-mouth perception may be provided in comparison to block tufts known in the art.

In some embodiments, the parallelogram may be a square or a rhombus. In the context of the present disclosure, a rhombus is defined as a parallelogram with four sides of equal length, while a square has four sides of equal length and angles of equal size, i.e. of substantially 90°. A "block tuft" having a cross-sectional area in the shape of a square may provide a smooth transition perception when the teeth come into contact with the "block tuft", wherein the transition perception is similar in the longitudinal and in the vertical brushing direction, i.e. in a brushing direction along the rows of teeth and in an up-and-down direction from the teeth to the gums and vice versa, which may further improve the in-mouth perception of the "block tuft".

In some embodiments, the length of each side of the parallelogram may be from 4.5 mm to 10 mm, optionally 7 mm. It has been surprisingly found out that the length of the sides of the "block tuft" should not exceed 10 mm as the "block tuft" may lose its ability to adapt to the teeth contour and only the most elevated areas of the teeth surfaces may be brushed.

In some embodiments, the at least one tuft may comprise filaments having a longitudinal axis and a cross-sectional area extending in a plane perpendicular to the longitudinal axis. The cross-sectional area may have a substantially circular shape. The cross-sectional area may have a diameter from 0.12 mm to 0.16 mm, optionally of 0.127 mm (5 mil) or 0.152 mm (6 mil). Such type of tuft comprises relatively thin and soft filaments which may provide a gentle brushing sensation. The relatively thin filaments may provide a gentle cleaning action; a stinging sensation/unpleasant feeling on the gums during brushing may be substantially avoided. In addition, filaments having a relatively small diameter, e.g. 5 mil or 6 mil, can adapt to the teeth contour easily as the bending stiffness is lower compared to filaments having a larger diameter. A head for an oral care implement may be provided which may provide both, good adaptability of the filaments and improved cleaning performance on the buccal, lingual and occlusal surfaces due to increased stability/bending stiffness of the overall "block tuft". Further, a gentle cleaning effect substantially without a pricking sensation may be provided.

In some embodiments, the at least one tuft may have a free end having a topography which may be concave or convex. A concave or convex topography may provide increased adaptability of the "block tuft" to the teeth contour to increase the contact area between the "block tuft" and the teeth surfaces and, thus, to remove plaque and other residues more effectively. Further, the filaments of such "block tuft" having the longer length may penetrate deeper into interdental spaces. The overall cleaning performance may be further improved.

In some embodiments, the at least one tuft may comprise filaments which extend from the mounting surface over a length from 10 mm to 12 mm, optionally over 11 mm. In the context of this disclosure, the length of a filament or tuft may be defined by the extension of the filament/tuft measured from its lower end being secured at the mounting surface of the head to its upper free/loose end.

In some embodiments, the head may further comprise at least one circular tuft having a longitudinal axis and a cross-sectional area extending in a plane perpendicular to the longitudinal axis. The cross-sectional area may have a substantially circular shape with a diameter from 1.5 mm to 2 mm, optionally of 1.7 mm. A combination of the "block tuft" in accordance with the present disclosure with at least one circular tuft may further enhance the cleaning performance of the head. In some embodiments, the head may comprise a plurality of circular tufts. In the course of virtual brushing simulations it has been surprisingly found out that a head comprising both, a "block tuft" in accordance with the present disclosure and a plurality of circular tufts having a diameter of 1.7 mm provides increased cleaning performance compared to a head comprising said circular tufts only. It has been found out that a head comprising a "block tuft" in accordance with the present disclosure and circular tufts applies more stress onto the teeth surfaces compared to a head comprising circular tufts only. Since exceeding a certain level of stress is a requirement for removing plaque from the teeth surfaces effectively, the head according to said embodiment provides more efficient plaque removal. Further, as teeth have a heterogenic surface topography including large and slightly curved surfaces beside deep and narrow gaps, like interdental areas, a head in accordance to said embodiment may provide improved overall cleaning capabilities, i.e. both, good interdental penetration properties and effective buccal, lingual and occlusal surface cleaning. The at least one "block tuft" in accordance with the present disclosure may provide intensive surface cleaning and polishing effects on the relatively large and slightly curved surfaces, while the at least one circular tuft may penetrate into narrow gaps to clean these spaces effectively. In other words, a head in accordance to said embodiment has the ability to adapt to the relatively large and slightly curves teeth surfaces as well as to the broken and fissured topography of the teeth and, thus, to also clean hard to reach areas.

Further, test results revealed that due to the difference in filament density between the "block tuft" and the circular tufts a smooth transition between these types of tufts is of importance to provide a comfortable and pleasant in-mouth perception of the tuft pattern. A smooth transition may be achieved by a tuft pattern in which no side of the parallelogram of the "block tuft" is orthogonal to a longitudinal or vertical brushing motion. It has been surprisingly found out that otherwise the transition from the circular tuft to the "block tuft" appears as a "step" in stiffness perception which may disturb the brushing action when the head is moved in the longitudinal or vertical direction. As the diagonal of the "block tuft" is substantially parallel to the longitudinal axis of the head, one of the edges/angles of the tuft comes first into contact with the teeth. At that point of contact the "block tuft" has a stiffness similar to the circular tufts resulting in an in-mouth perception similar to the circular tufts. With further movement, the width of the "block tuft" increases continuously and therewith the stiffness resulting in a homogeneous transition. In other words, a smooth transition between the circular tufts and the "block tuft" is provided for a brushing motion in longitudinal and vertical directions, i.e. along the rows of the teeth as well as for up-and-down movement form the teeth to the gums and vice versa.

In some embodiments, the at least one circular tuft may comprise filaments having a longitudinal axis and a cross-sectional area extending in a plane perpendicular to the longitudinal axis. The cross-sectional area may have a substantially circular shape with a diameter being larger than the diameter of the filaments of the at least one "block tuft". Such head may provide improved overall cleaning performance. While the "block tuft" may adapt to the teeth contour easily due to the relatively large cross-sectional area and its relatively thin and soft filaments, the at least one circular tuft may provide good interdental penetration due to the increased stiffness of the filaments having a larger diameter. In other words, a head for an oral care implement is provided that may remove plaque and other residues more effectively both, on substantially flat and slightly curved surfaces as well as in interdental spaces. The "block tuft" and the at least one circular tuft may work synergistically together for overall improved cleaning performance.

In some embodiments, the diameter of the filaments of the at least one circular tuft may be from 0.17 mm to 0.18, optionally 0.178 mm (7 mil). In some embodiments, the diameter of the filaments of the at least one "block tuft" in accordance with the present disclosure may be 0.127 mm (5 mil) or 0.152 mm (6 mil) and the diameter of the filaments of the at least one circular tuft may be 0.178 mm (7 mil).

In some embodiments, the at least one circular tuft may extend from the mounting surface of the head over a length from 10 mm to 12 mm, optionally over 11 mm. In case the at least one "block tuft" and the at least one circular tuft may have substantially the same length extension, a head for an oral care implement may be provided which provides an even more smooth transition perception between the at least one circular tuft and the "block tuft" which may lead to improved in-mouth perception.

In some embodiments, the at least one circular tuft may be arranged on the mounting surface of the head next to one side of the parallelogram. Such tuft arrangement may provide an even smoother transition perception between the at least one circular tuft and the at least one "block tuft" resulting in even more comfortable and pleasant in-mouth perception.

In some embodiments, the head may comprise a plurality of circular tufts. At least one circular tuft may be arranged next to each side of the parallelogram, respectively. Such tuft arrangement may provide an even smoother transition perception between the circular tufts and the at least one "block tuft" resulting in even more comfortable and pleasant in-mouth perception.

In some embodiments, the filaments of the at least one tuft in accordance with the present disclosure and/or the filaments of the at least one circular tuft may be substantially cylindrical filaments with end-rounded tips or they may be tapered filaments having a pointed tip. Tapered filaments may achieve optimal penetration into areas between two teeth as well as into gingival pockets during brushing and may provide improved cleaning properties. The pointed tip may be needle shaped, may comprise a split or a feathered end. The tapering portion may be produced by a chemical and/or mechanical tapering process.

The filaments may be made up from a thermoplastic elastomer material (TPE) with or without an abrasive such as kaolin clay, from nylon with or without an abrasive such as kaolin clay, from polybutylene terephtalate (PBT) with or without an abrasive such as kaolin clay or from nylon indicator material colored at the external surface. The coloring on nylon indicator material is slowly worn away as the filament is used over time to indicate the extent to which the filament is worn.

In some embodiments, the at least one tuft may be attached to the head by means of a hot tufting process. One method of manufacturing the oral care implement may comprise the following steps: In a first step, the at least one tuft may be formed by providing a desired amount of filaments. In a second step, the at least one tuft may be placed into a mold cavity so that ends of the filaments which are supposed to be attached to the head extend into said cavity. The opposite ends of the filaments not extending into said cavity may be either end-rounded or non-end-rounded. For example, the filaments may be not end-rounded in case the filaments are tapered filaments having a pointed tip. In a third step the head or an oral care implement body comprising the head and the handle may be formed around the ends of the filaments extending into the mold cavity by an injection molding process, thereby anchoring the at least one tuft in the head. Alternatively, the at least one tuft may be anchored by forming a first part of the head—a so called "sealplate"—around the ends of the filaments extending into the mold cavity by an injection molding process before the remaining part of the oral care implement is formed. Before starting the injection molding process the ends of the at least one tuft extending into the mold cavity may be optionally melted or fusion-bonded to join the filaments together in a fused mass or ball so that the fused masses or balls are located within the cavity. The at least one tuft may be held in the mold cavity by a mold bar having blind holes that correspond to the desired position of the at least one tuft on the finished head of the oral care implement. In other words, the at least one tuft attached to the head by means of a hot tufting process may be not doubled over a middle portion along their length and may be not mounted in the head by using an anchor/staple. The at least one tuft may be mounted on the head by means of an anchor free tufting process.

The oral care implement may be a toothbrush comprising a handle and a head according to any of the embodiments described above. The head extends from the handle and may be either repeatedly attachable to and detachable from the handle or the head may be non-detachably connected to the handle. The toothbrush may be an electrical or a manual toothbrush.

The following is a non-limiting discussion of an example embodiment of an oral care implement in accordance with the present disclosure, where reference to the Figures is made.

Figure 2:
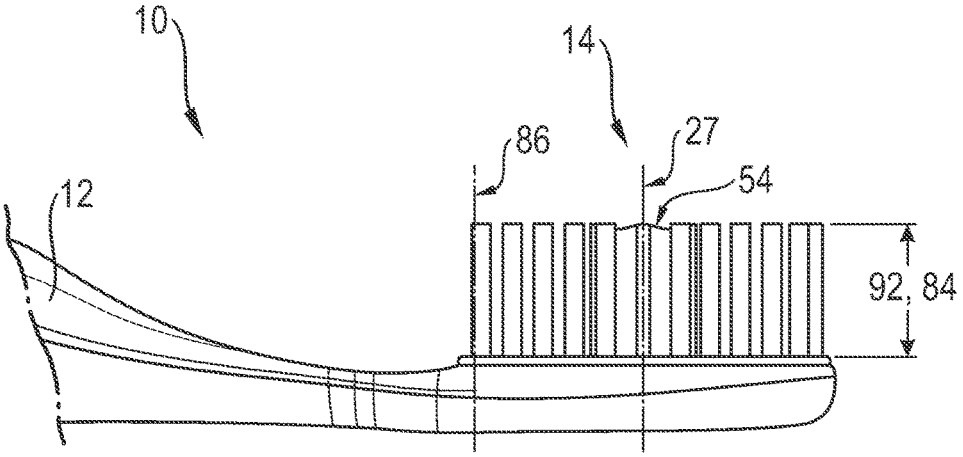
FIG. 2 shows a side view of the oral care implement of FIG. 1.
Figure 3:
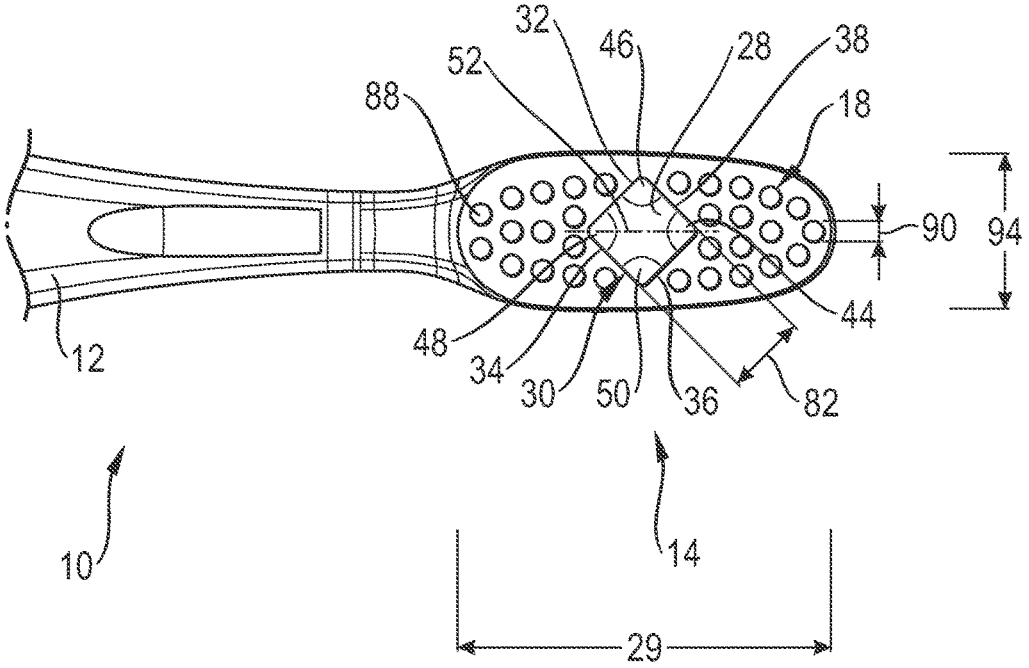
FIG. 3 shows a top down view of the oral care implement of FIG. 1.

FIGS. 1 to 3 show an embodiment of an oral care implement 10, which could be a manual or an electrical toothbrush 10 comprising a handle 12 and a head 14 extending from the handle 12 in a longitudinal direction. The head 14 has a proximal end 22 closest to the handle 12 and a distal end 24 furthest away from the handle 12, i.e. opposite the proximal end 22. The head 14 comprises a mounting surface 20 which may have substantially the shape of an oval with a longitudinal axis 26 extending between the proximal end 22 and the distal end 24, i.e. along the maximum longitudinal extension 29 of the mounting surface 20. Two different types of tufts 16, 18 may be secured to the head 14 by means of a hot tufting process. The tufts 16, 18 may extend from the mounting surface 20 of the head 14 in a substantially perpendicular manner.

Tuft 16 in accordance with the present disclosure has a longitudinal axis 27 and a cross-sectional area 28 extending in a plane perpendicular to the longitudinal axis 27. The cross sectional area 28 has a shape substantially of a parallelogram 30 with two pairs of substantially parallel sides 32, 34, 36, 38. The sides 32, 34, 36, 38 form four angles 44, 46, 48, 50. The tuft 16 extends from the mounting surface 20 in a manner that a diagonal 52 which joins two non-consecutive angles 44, 48, i.e. two opposite angles 44, 48, is substantially parallel to the longitudinal axis 26 of the mounting surface 20.

The parallelogram 30 may have the shape of a square or a rhombus. In case the parallelogram 30 has the shape of a square, the four sides 32, 34, 36, 38 of the parallelogram 30 form an angle 44, 46, 48, 50 with respect to the longitudinal axis 26 of the mounting surface 20 of substantially 45°.

Each side 32, 34, 36, 38 of the parallelogram 30 has a length 82 of at least 3.5 mm. In some embodiments, the length 82 of each side 32, 34, 36, 38 may be from 4.5 mm to 10 mm. In the embodiment shown in FIGS. 1 to 3, the parallelogram 30 may have the shape of a square with a length 82 of each side 32, 34, 36, 38 of 7 mm.

Tuft 16 may comprise filaments having a longitudinal axis and a cross-sectional area extending in a plane perpendicular to the longitudinal axis. The cross-sectional area of the filaments may have a substantially circular shape. The diameter of the filaments may be from 0.12 mm to 0.16 mm, optionally of 0.127 mm (5 mil) or 0.152 mm (6 mil). The filaments of tuft 16 may have a length 84 from 10 mm to 12 mm, optionally of 11 mm counting from the mounting surface 20 to the filaments' free ends.

The tuft 16 may have a free end 54 having a topography which may be concave or convex to increase adaptability of the tuft 16 to the teeth contour and to provide more interdental penetration of the filaments having the longer length. In the embodiment shown in FIGS. 1 to 3, the filaments may have a diameter of 0.127 mm (5 mil) and a maximum length of 11 mm (in the outer part of tuft 16) and a minimum length of 10 mm (in the inner part of tuft 16) thereby forming a concave topography of the free end 54 of the tuft 16.

The filaments of tuft 16 may provide each other with a counterforce during a brushing action and, thus, with increased stability/bending stiffness which may result in increased contact pressure when the filaments come into contact with the teeth. The increased contact pressure may force the longer filaments of tuft 16 to penetrate more easily into interdental spaces wherein a gentle brushing sensation may be provided due to the relatively thin dimensions of the filaments (5 mil to 6 mil).

Tuft 16 may be arranged on the mounting surface 20 substantially in the central part thereof and may be surrounded by a plurality of circular tufts 18. The circular tufts 18 may have a longitudinal axis 86 and a cross-sectional area 88 extending in a plane perpendicular to the longitudinal axis 86. The cross-sectional area 88 may have a substantially circular shape with a diameter 90 of 1.5 mm to 2.0 mm, optionally of 1.7 mm. The circular tufts 18 may comprise cylindrical filaments having a longitudinal axis and a cross-sectional area extending in a plane perpendicular to the longitudinal axis. The cross-sectional area may be substantially circular with a diameter which may be larger than the diameter of the filaments of tuft 16. The diameter of the filaments of the circular tufts 18 may be from 0.17 mm to 0.18 mm, optionally of 0.178 mm (7 mil). The circular tufts 18 may have a length 92 from 10 mm to 12 mm, optionally of 11 mm, counting from the mounting surface 20 to the tufts' free ends.

Tufts 18 may be arranged in a plurality of rows which may be aligned substantially parallel to the width extension 94, i.e. substantially perpendicular to the longitudinal axis 26 of the mounting surface 20. In addition, next to each side 32, 34, 36, 38 of the parallelogram 30, one tuft 18 may be attached to the mounting surface 20, respectively.

The filaments of tuft 16 and tufts 18 may be tapered filaments having a pointed tip or substantially cylindrical filaments with end-rounded tips.

The filaments of tuft 16 and tufts 18 may be made up from a thermoplastic elastomer material (TPE) with or without an abrasive such as kaolin clay, from nylon with or without an abrasive such as kaolin clay, from polybutylene terephtalate (PBT) with or without an abrasive such as kaolin clay or from nylon indicator material colored at the external surface. The filaments of tuft 16 may be made up of a different material as the filaments of tufts 18.

Comparison Experiments

Robot Tests:

A head for an oral care implement in accordance with the present disclosure (example embodiment, cf. FIGS. 1 to 3) and a head for an oral care implement according to a comparative example (comparative example) were compared with respect to their efficiency of plaque substitute removal on artificial teeth (typodonts).

Example Embodiment

Tuft pattern: cf. FIGS. 1 to 3
Length extension 29 of the brush head 14: 37.5 mm
Tuft 16:
Cross-sectional shape of tuft 16: square
Length 82 of each side 32, 34, 36, 38 of tuft 16: 7 mm
Topography of free end 54 of tuft 16: concave
Length 84 of filaments of tuft 16: minimum: 10 mm (inner filaments) to maximum: 11 mm (outer filaments)
Cross-sectional shape of filaments of tuft 16: circular
Diameter of filaments of tuft 16: 0.127 mm (5 mil)
Tufts 18:
Cross-sectional shape 88 of tufts 18: circular
Diameter of tufts 18: 1.7 mm
Length of filaments 92 of tufts 18: 11 mm
Cross-sectional shape of filaments of tufts 18: circular
Diameter of filaments of tufts 18: 0.178 mm (7 mil)
Material of all filaments: Nylon PA6.12

Comparative Example

Length extension of the head: 37.5 mm
Tuft pattern: 10 rows comprising the following number of tufts:
$1^{st}$ row (at the proximal end of the head): 2 tufts
$2^{nd}$ row: 3 tufts
$3^{rd}$ row: 3 tufts
$4^{th}$ row: 4 tufts
$5^{th}$ row: 4 tufts
$6^{th}$ row: 4 tufts
$7^{th}$ row: 4 tufts
$8^{th}$ row: 3 tufts
$9^{th}$ row: 2 tufts
$10^{th}$ row (at the distal end of the head): 1 tuft
Cross-sectional shape of tufts: circular
Diameter of tufts 1.7 mm
Cross-sectional shape of the filaments of tufts: circular
Diameter of the filaments of tufts: 0.178 mm (7 mil)
Length of the filaments of tufts: 11 mm
Material of all filaments: Nylon PA6.12

Brushing tests were performed using a robot system KUKA 3 under the following conditions (cf. Table 1):

TABLE 1

| Product | program upper jaw | program lower jaw | force | power supply |
|---|---|---|---|---|
| All tested products | EO_INDI | EU_INDI | 3 N | no |
| total cleaning time | 60 s | 60 s | | |
| program version | 9.11.09 Eng | 9.11.09 Eng | | |
| SYSTEC speed | 60 | 60 | | |
| SYSTEC amplitude x/y | 20/0 | 20/0 | | |

TABLE 1-continued

| Product | program upper jaw | program lower jaw | force | power supply |
|---|---|---|---|---|
| number of moves | 3 | 3 | | |
| Movement | | horizontal | | |
| used handle/mould | | No/no | | |

Figure 4:
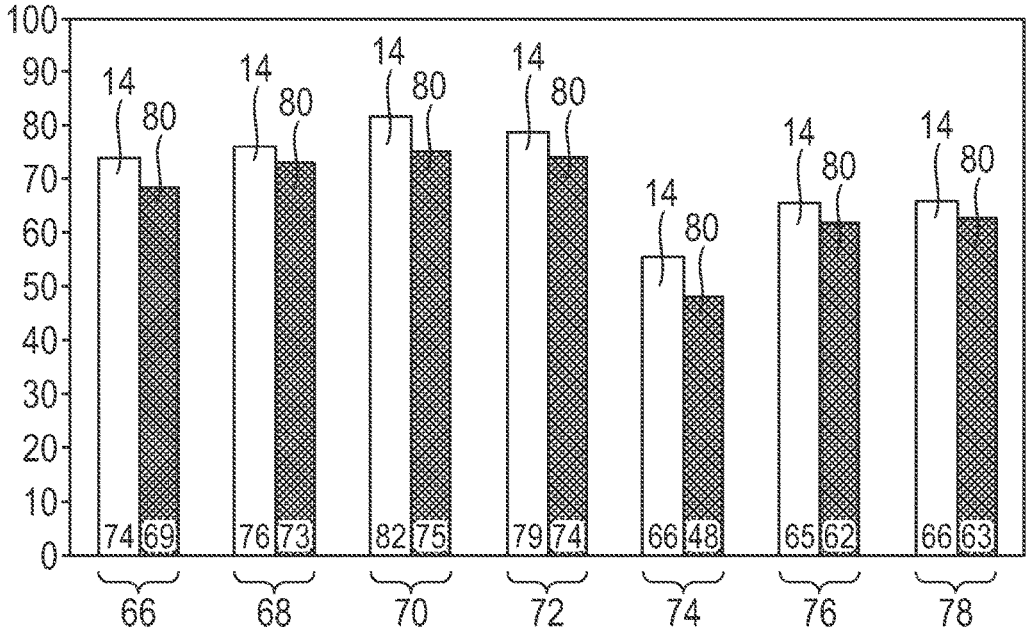
FIG. 4 shows a diagram in which brushing results of the oral care implement of FIG. 1 are compared with brushing results of an oral care implement according to a comparative example embodiment.

FIG. 4 shows the amount of plaque substitute removal in % of the example embodiment 14 and the comparative example 80, each with respect to all tooth surfaces 66, buccal surfaces 68, lingual surfaces 70, lingual and buccal surfaces 72, occlusal surfaces 74, the gum line 76 and interdental surfaces 78.

FIG. 4 clearly shows that the example embodiment 14 provides significant improved plaque removal properties with respect to all tooth surfaces 66, buccal surfaces 68, lingual surfaces 70, lingual and buccal surfaces 72, occlusal surfaces 74, the gum line 76 and interdental surfaces 78 compared to the comparative example 80. The most significant improvement of the cleaning performance occurred on the occlusal surfaces 74 with an improvement of 16%.

Sensory Tests:

Further, sensory tests showed performance advantages of the example embodiment 14. Sensory tests enable trained and experienced panelists to evaluate the effects of oral care implements in comparison with a defined standard. The sensory tests, i.e. sensorial evaluation of the brush head according to the example embodiment 14 without usage of toothpaste were carried out by 5 trained and experienced sensory experts for the following criteria: interdental cleaning, overall in-mouth perception, stiffness and stability of the tuft pattern. The sensorial evaluation of the example embodiment 14 as described above was as follows:

"There is a lot of bristle contact and the perception of surface cleaning is very high."

"The interaction with the gum is intensive, but in a very gentle and massaging/stimulating way."

Overall, the tuft 16 was perceived very positively, confirming that the tuft 16 did not create an unpleasant in-mouth sensation. Quite the contrary, the tuft 16 according to the present disclosure was perceived as an intensive surface cleaning/polishing element.

In the context of this disclosure, the term "substantially" refers to an arrangement of elements or features that, while in theory would be expected to exhibit exact correspondence or behavior, may, in practice embody something slightly less than exact. As such, the term denotes the degree by which a quantitative value, measurement or other related representation may vary from a stated reference without resulting in a change in the basic function of the subject matter at issue.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

What is claimed is:

1. A head (14) for a manual oral care implement (10) comprising:

a longitudinally elongated mounting surface (20) having a maximum longitudinal extension (29) and a longitudinal axis (26) extending along said maximum longitudinal extension (29), the head (14) further comprising at least one tuft (16) extending from the mounting surface (20), the at least one tuft (16) having a longitudinal axis (27) and a cross-sectional area (28) extending in a plane perpendicular to the longitudinal axis (27) and having a shape substantially of a parallelogram (30) with two pairs of substantially parallel sides (32, 34, 36, 38) forming four angles (44, 46, 48, 50), and a diagonal (52) joining two non-consecutive angles (32, 36) of the parallelogram (30), the sides (32, 34, 36, 38) of the parallelogram (30) having a length (82) of at least 3.5 mm, wherein the at least one tuft (16) extends from a central part of the mounting surface (20) in a manner that the diagonal (52) of the parallelogram (30) is substantially parallel to the longitudinal axis (26) of the mounting surface (20), wherein the at least one tuft (16) has a free end (54) having a topography which is concave or convex, and wherein the at least one tuft comprises filaments individually extending from the mounting surface (20) of the head (14).

2. The head (14) according to claim 1, wherein the parallelogram is a square.

3. The head (14) according to claim 1, wherein the parallelogram is a rhombus.

4. The head (14) according to claim 1, wherein the length (82) of each side (32, 34, 36, 38) is from 4.5 mm to 10 mm.

5. The head (14) according to claim 1, wherein each of the filaments of the at least one tuft (16) has a longitudinal axis and a cross-sectional area extending in a plane perpendicular to the longitudinal axis and the cross-sectional area has a substantially circular shape.

6. The head (14) according to claim 1, wherein the filaments individually extending from the mounting surface (20) extend to a length (84) of from 10 mm to 12 mm over the mounting surface.

7. The head (14) according to claim 1, wherein the head (14) further comprises at least one circular tuft (18) having a longitudinal axis (86) and a cross-sectional area (88) extending in a plane perpendicular to the longitudinal axis (86) and the cross-sectional area (88) has a substantially circular shape with a diameter (90) from 1.5 mm to 2 mm.

8. The head (14) according to claim 7, wherein the at least one circular tuft (18) comprises filaments having a longitudinal axis and a cross-sectional area extending in a plane perpendicular to the longitudinal axis and the cross-sectional area has a substantially circular shape with a diameter being larger than the diameter of the filaments of the at least one tuft (16).

9. The head (14) according to claim 8, wherein the diameter of the filaments of the at least one circular tuft (18) is from 0.17 mm to 0.18 mm.

10. The head (14) according to claim 9, wherein the diameter of the filaments of the at least one circular tuft (18) is 0.178 mm (7 mil).

11. The head (14) according to any of claim 7, wherein, the at least one circular tuft (18) extends from the mounting surface (20) of the head (14) over a length (92) from 10 mm to 12 mm.

12. The head (14) according to any of claim 11, wherein, the at least one circular tuft (18) extends from the mounting surface (20) of the head (14) over a length (92) of over 11 mm.

13. The head (14) according to claim 7, wherein the at least one circular tuft (18) is arranged next to one side (32, 34, 36, 38) of the parallelogram (30).

14. The head (14) according to claim 7, wherein the head (14) comprises a plurality of circular tufts (18) and at least one circular tuft (18) is arranged next to each side (32, 34, 36, 38) of the parallelogram (30).

15. The head (14) according to claim 7, wherein the diameter (90) is 1.7 mm.

16. The head (14) according to claim 1, wherein the at least one tuft (16) is attached to the head (14) by means of a hot-tufting process.

17. The head (14) according to claim 1, wherein the at least one tuft (16) comprises filaments extending from the mounting surface (20) over a length (84) of over 11 mm.

18. The head (14) according to claim 1, wherein the length (82) of each side (32, 34, 36, 38) is about 7 mm.

* * * * *